US006336632B1

(12) United States Patent
London

(10) Patent No.: US 6,336,632 B1
(45) Date of Patent: Jan. 8, 2002

(54) GAME SET, INCLUDING BOARD AND CHESSMEN AND RELATED METHODS AND PRODUCTS

(76) Inventor: Alexander London, 8158 Avenida Navidad, No. 23, San Diego, CA (US) 92122-4409

( * ) Notice: Subject to any disclaimer, the term of this patent is extended or adjusted under 35 U.S.C. 154(b) by 0 days.

(21) Appl. No.: 09/542,407

(22) Filed: Apr. 4, 2000

(51) Int. Cl.[7] ..... A63F 3/02
(52) U.S. Cl. ..... 273/261
(58) Field of Search ..... 273/261, 260

(56) References Cited

U.S. PATENT DOCUMENTS

| | | | | | |
|---|---|---|---|---|---|
| 4,033,586 | A | | 7/1977 | Carinthios | |
| 4,856,789 | A | * | 8/1989 | Carlson | 273/261 |
| 5,280,913 | A | * | 1/1994 | Sirk | 273/261 |
| 5,421,582 | A | | 6/1995 | Ritter | |
| 5,511,793 | A | | 4/1996 | Watt et al. | |
| 5,642,885 | A | * | 7/1997 | Sustin | 273/261 |
| 5,749,583 | A | * | 5/1998 | Sadounichvili et al. | 273/261 |

FOREIGN PATENT DOCUMENTS

| | | | | |
|---|---|---|---|---|
| GB | 2201351 | * | 9/1988 | 273/261 |

OTHER PUBLICATIONS

"Double Chess", Julian S. Grant Hayward, The Chess Variant Pages, www.chessvariants.com, Sep. 1996.*
"N by N chess games", A. Missoum, The Chess Variant Pages, www.chessvariants.com, Apr. 1997.*
"Euchess", Carlos Cetina, The Chess Variant Pages, www.chessvariants.com, Dec. 1998.*

* cited by examiner

*Primary Examiner*—Benjamin H. Layno

(57) ABSTRACT

The present invention relates generally to a new game, termed "Next Chess" (and related products and methods) Next Chess is played on a board similar to a conventional chess board, but instead being 10 files wide and 8 ranks deep. Notation is like a standard algebraic chessboard, with two files added between the d file and the e file. The new files preferably are designated y and z. The files a through d, and e through h have the traditional pieces and Pawns placed on them. Each side has 10 Pawns: for White all on the second rank, for Black all on the seventh rank.

1 Claim, 1 Drawing Sheet illustrating an 8 X 10 chess board having two sets of 20 chessmen set up on the board.

illustrating a two conventional sets of 16 chessmen including two set of 6 additional chessmen for a total of 22 chessmen in each set.

09/542,407 Chess game having a board with eight rows and ten columns.

Figure 1 illustrating an 8 X 10 chess board having two sets of 20 chessmen set up on the board.
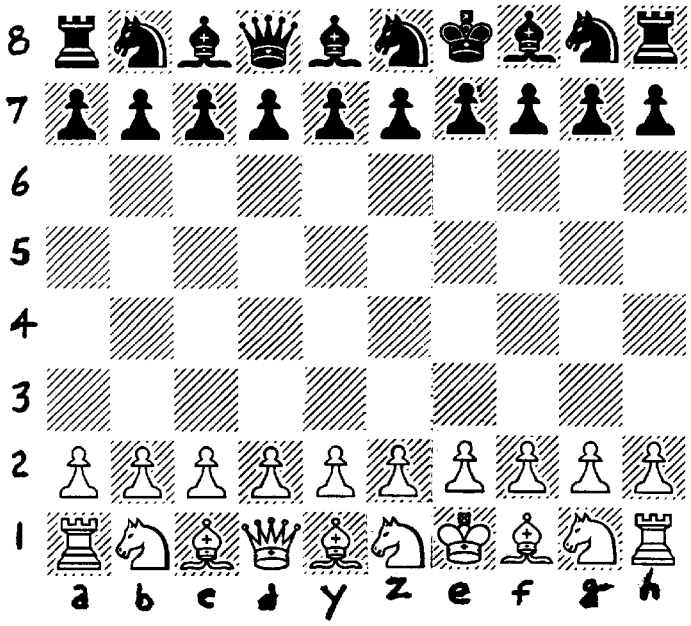
Figure 2 illustrating a two conventional sets of 16 chessmen including two set of 6 additional chessmen for a total of 22 chessmen in each set.
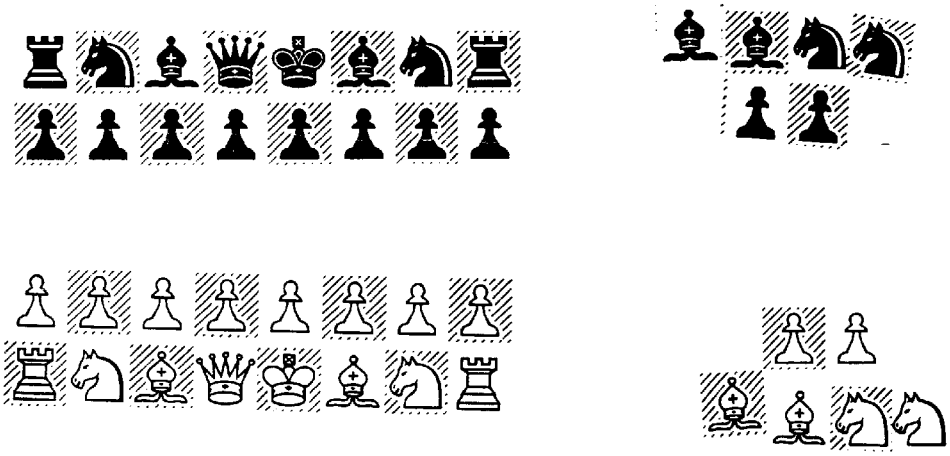
09/542,407 Chess game having a board with eight rows and ten columns.

GAME SET, INCLUDING BOARD AND CHESSMEN AND RELATED METHODS AND PRODUCTS

INTRODUCTION

The present invention relates generally to products and methods for playing a game, termed "Next Chess."

BACKGROUND OF THE INVENTION

Publications and other reference materials referred to herein are incorporated herein by this reference. The following description of the background of the invention is intended to aid in the understanding of the invention, but is not admitted to describe or constitute prior art to the invention.

Orthodox chess is a game for two players, played upon an eight-by-eight square, checkered game board. Chess rules and movements of the chessmen have been largely the same for about five hundred years. The game uses six types of chessmen. The King moves any direction one square at a time. The rook moves in a straight direction (vertically or horizontally) any number of squares. The bishop moves diagonally any number of squares. The knight's movement is "L-shaped," two squares in one straight direction, then one square sideways (this piece alone can jump, or leap, over an intervening piece). The queen has a choice of movement like a bishop or a rook in any one turn. The pawn moves one square forward, with the option of two squares on its first move. A pawn must be promoted to any other piece except a king when it reaches the last rank.

The pawn captures diagonally forward one square, whereas the other chessmen capture in their ordinary movement. A capture removes one of the opponent's chessmen from play, and thus no two chessmen occupy the same square at the same time and a player may not capture his or her own piece. Pawns may also capture other pawns "en passent". This rule applies when a first player's pawn is adjacent to an opponent's pawn that has moved two squares forward on the previous move. On the next move, the first player may then capture the adjacent pawn by moving diagonally and removing the opponent's pawn.

The castling move simultaneously moves a player's king and rook, whereby over unoccupied and unthreatened squares, the king is moved two squares horizontally, right or left, toward a rook, and that rook is moved over the king to the adjacent square.

Turns alternate between the two players, also called opponents or sides, white or black, until one player checkmates the other. In checkmate, a player's king cannot successfully move out of a check, where it is threatened with capture. Alternatively, one player may resign and lose at any point during play or the players may agree to a draw or tie during the game. Finally, a draw or tie is also declared if a player is in "stalemate", which means it is the player's turn to move but has no legal move that may be made. Briefly, these are the rules for movements and play of the chessmen in orthodox, or classical, or standard chess, all three terms being used synonymously.

A thirteenth century Turkish Great chess, played on a thirteen-by thirteen board has a gazelle that has a one-diagonal, two-straight move.

A fourteenth century historical variant played in Persia, Timur's Chess utilizes an eleven-by-ten board. Only the rooks, knights, and king have moves congruent with orthodox counterparts. Eleven pawns initial position are in the third rank, and they can never move two squares at once. Three different bishop-like chessmen move respectively one square at a time, two squares at a time, and two or more at a time. Two other rooklike chessmen move respectively one-square and two-square. All the foregoing moves are required to be in the same direction, and some of them include leaping ability.

Created in 1899 by Ben R. Foster (U.S.A.), Chancellor Chess has a nine-by-nine board and one new piece for each side. A chancellor can move either as a rook or as a knight in one play. With symmetrical initial positioning, all the bishops start on the same-colored squares.

In the 1920's, world chess champions, Jose Raul Capablanca and Emanuel Lasker together advocated an expansion of chess, now termed Capablanca Chess. This variant entails adding two new chessmen for each player, one between each knight and bishop, on an eight-by-ten board. A chancellor moves either like the rook or the knight, and a cardinal moves either like the bishop or the knight.

Created in 1922 by Edgar Rice Burroughs, Jetan, or Martian Chess is played on a ten-by-ten game board. No piece has a role of movement just like an orthodox piece.

U.S. Pat. No. 4,033586, Jul. 5, 1977, to Michael J. Carinthios, discloses a variation called Grandchess. It is played on a nine-by-nine board with the elimination of the queen as such and the introduction of two princes for each side. The prince moves the same as the ordinary queen.

U.S. Pat. No. 5,421,582, Jun. 6, 1995, to Carl E. Ritter, discloses a modified chess game played upon a large octagonal board. This version of chess introduces a new piece, a viceroy, with a new manner of movement. The viceroy moves two squares at a time in the same straight or diagonal direction. The game retains the six orthodox chess chessmen and otherwise follows most of the standard rules of chess and the large board of one hundred thirty-six squares encourages indirect, diversionary play.

U.S. Pat. No. 5,511,793, Apr. 30, 1996, to James S. Watt and Hi Kapaa, discloses variations of chess on square boards ranging in size up to twelve by twelve. New chessmen obtain their moving ability from combinations of four pieces, rook, bishop, knight, and bowman. The bowman extends a knight's potential movement by traveling two "linear dog-legs," as the inventors term it.

SUMMARY OF THE INVENTION

The present invention relates generally to a new game, termed "Next Chess" and related products and methods. Next Chess is played on a board similar to a conventional chess board (8 files wide and 8 ranks deep), but instead being 10 files wide and 8 ranks deep. Notation is like a standard algebraic chessboard (files a to h and ranks 1 to 8), with two files added between the d file and the e file. The new files preferably are designated y and z. The files a through d, and e through h have the traditional pieces and Pawns placed on them. Each side has 10 Pawns: for White all on the second rank, for Black all on the seventh rank.

All the rules of traditional chess apply. There are no new rules. For example, to castle, the rule remains that the King moves two squares toward the Rook, and the Rook is placed on the other side of the King. Therefore the result of Kingside castling is the same as in traditional chess, but castling Queenside results in the King moving to the y file, and the Rook moving to the z file.

There are several advantages to Next Chess compared to conventional chess or existing variations thereof, including:

(a) it uses only existing pieces; (b) it uses only existing rules; (c) the huge increase in complexity means there will be fewer draws; (d) it will take another century for openings to become known, therefore book knowledge will not be a safe refuge; (e) the opening is the most complicated part of chess; now even Grandmasters will be completely on their own; (f) computers will not be as strong as they have been, but may be much stronger than humans—at first; (g) it is easy to give Black compensation for White's first move advantage by giving Black an extra Bishop to White's Knight; (h) being a Pawn behind is not as serious as in traditional chess because there is so much extra material that must be traded off in order to get to the endgame; (i) the attacker has more material available to sacrifice, so attacks are harder to defend against, and therefore games are more interesting; and (j) the first move is not as important as in traditional chess.

Thus, in one aspect, the present invention provides a game set. The game set includes: (a) a rectangular board with a grid of eight squares of a unit dimension on two opposing sides of the board and ten squares of the unit dimension on the other two sides of said board; and (b) two sets of twenty chessmen, each set being a different color and consisting of ten pawns, a king, a queen, two rooks and four pieces selected from the group consisting of bishops and knights, provided that there are at least two bishops and two knights in each set of pieces. In preferred embodiments, the game also includes directions for using the board and the chessmen and/or a package or container for the board and the chessmen.

For purposes of this description, a set of chessmen of either traditional chess or Next Chess is defined as consisting of a given number of Pawns, and a similar number of pieces, which are the King, the Queen, the Rooks, the Bishops and the Knights. In this manner, pieces are distinguished from Pawns.

In preferred embodiments, the invention features a game set comprising:

(a) Two sets of 22 chessmen, each set being of a different color or appearance, and consisting of a traditional chess set; that is, eight Pawns, one King, one Queen, two Rooks, two Bishops, and two Knights; plus two additional Pawns, two additional Bishops and two additional Knights.

(b) In any one of the many varieties described herein, only 20 chessmen would be used: Ten Pawns, one King, one Queen, two Rooks, two Bishops, two Knights, plus either (i) one Bishop and one Knight; or (ii) two Bishops; or (iii) two Knights. Depending on the variant of Next Chess chosen for an individual game, the opponent may have the same pieces of his own color, or have piece that will create one of the Unbalanced varieties.

In a second aspect, the present invention features a set of at least twenty game chessmen including ten pawns, a king, a queen, two rooks and four pieces selected from the group consisting of bishops and knights, provided that there are at least two bishops and two knights in each set of pieces. In a preferred embodiment, the set consists of twenty game chessmen and/or the chessmen are all of the same color.

Another aspect of the invention features directions for using: (a) a game board comprising a rectangular board with a grid of eight squares of a unit dimension on two opposing sides of the board and ten squares of the unit dimension on the other two sides of the board; and (b) a set of at least twenty game chessmen comprising ten pawns, a king, a queen, two rooks and four pieces selected from the group consisting of bishops and knights, provided that there are at least two bishops and two knights in each set of pieces, wherein the directions comprise instructions for placing the chessmen on the board and sequentially moving the chessmen in accordance with the rules of next chess (identical to the rules of orthodox chess except for the initial set up of chessmen, the extra chessmen and the different board).

Also provided is a package or container comprising material arranged and configured so as to be capable of holding or storing: (a) a game board comprising a rectangular board with a grid of eight squares of a unit dimension on two opposing sides of the board and ten squares of the unit dimension on the other two sides of the board; and (b) a set of at least twenty game chessmen comprising ten pawns, a king, a queen, two rooks and four pieces selected from the group consisting of bishops and knights, provided that there are at least two bishops and two knights in each set of pieces.

The invention also provides a method of making the game set described herein, comprising the steps of providing the board and providing the sets of chessmen. A method of using the game set described herein is also provided, comprising the steps of placing said chessmen on said board and sequentially moving said chessmen in accordance with the rules of Next Chess.

In another aspect, the invention provides a method of making the set described herein, comprising the step of providing the chessmen. Also provided is a method of using the set described herein, comprising the steps of placing the chessmen on a board and sequentially moving the chessmen in accordance with the rules of next chess.

In another aspect, the invention provides a method for making the directions described herein, comprising the step of providing said instructions. In another aspect, the invention provides a method for using the directions described herein, comprising the step of following the instructions and thereby placing the chessmen on the board and sequentially moving the chessmen in accordance with the rules of next chess.

In another aspect, the invention provides a method for making the package described herein, comprising the step of providing the material. In another aspect, the invention provides a method of using the package described herein, comprising the step of holding or storing the game board and the set of chessmen in the package.

The summary of the invention described above is non-limiting and other features and advantages of the invention will be apparent from the following description of the preferred embodiments, and from the claims.

BRIEF DESCRIPTION OF THE DRAWINGS

FIG. 1 illustrating an 8×10 chess board having two sets of 20 chessmen set up on the board.

FIG. 2 illustrating a two conventional sets of 16 chessmen including two set of 6 additional chessmen for a total of 22 chessmen in each set.

DETAILED DESCRIPTION OF THE INVENTION

The present invention provides products and methods for playing Next Chess. Several possible variations of Next Chess are possible in view of the eight-by-ten board and the number and distribution of chessmen. Preferred set ups or initial placements of chessmen are summarized below (in each case each side has two pawns on the y and z files on the second or seventh rank):

I. Balanced Chess or Bal Chess

There are four balanced variations of the initial set-up of chessmen on the new y file and z file: (1) Each side has a Knight on the y file, and a Bishop on the z file; (2) Each side has a Bishop on the y file, and a Knight on the z file; (3) Each side has a Bishop on both the y and z files; (4) Each side has a Knight on both the y and z files.

II. Compensation Chess or Comp Chess

There are four unbalanced variations of the initial set-up of chessmen on the new y file and z file to compensate Black for moving second: (1) White has a Bishop on the y file, and a Knight on the z file; Black has a Bishop on the y file, and another Bishop on the z file; (2) White has a Knight on the y file, and a Bishop on the z file; Black has a Bishop on the y file, and another Bishop on the z file; (3) White has Knight on the y file, and another Knight on the z file; Black has a Bishop on the y file, and a Knight on the z file; (4) White has a Knight on the y file, and another Knight on the z file; Black has a Knight on the y file, and a Bishop on the z file.

III Unbalanced Chess or Un Chess

There are three unbalanced variations of the initial set-up of chessmen on the new y file and z file: (1) White has a Bishop on the y file, and a Knight on the z file; Black has a Knight on the y file, and a Bishop on the z file; (2) White has a Knight on the y file, and a Bishop on the z file; Black has a Bishop on the y file, and a Knight on the z file; and (3) White has Knights in both y and z files and Black has Bishops in the y and z files.

IV. King on own color Chess or King Chess 10

In this variation, the White and Black Kings start on the z file. The White and Black Queens start on the y file.

V. King Balanced Chess or King Bal Chess

There are four balanced variations of the initial set-up of chessmen on the d and e files: (1) Each side has a Knight on the d file and a Bishop on the e file; (2) Each side has a Bishop on the d file and a Knight on the e file; (3) Each side has a Bishop on both the d and e files; (4) Each side has a Knight on both the d and e files.

VI. King Compensation Chess or King Comp Chess

There are four unbalanced variations of the initial set-up of chessmen on the d and e files: (1) White has a Bishop on the d file and a Knight on the e file; Black has a Bishop on the d file and another Bishop on the e file; (2) White has a Knight on the d file and a Bishop on the e file; Black has a Bishop on the d file, and another Bishop on the e file; (3) White has a Knight on the d file, and another Knight on the e file; Black has a Bishop on the d file, and a Knight on the e file; (4) White has a Knight on the d file and another Knight on the e file; Black has a Knight on the d file, and a Bishop on the e file.

VII. King Unbalanced Chess or King Un Chess

There are three unbalanced variations of the initial set-up of chessmen on the d and e files:

(1) White has a Bishop on the d file, and a Knight on the e file; Black has a Knight on the d file, and a Bishop on the e file.

(2) White has a Knight on the d file, and a Bishop on the e file; Black has a Bishop on the d file, and a Knight on the e file.

(3) White has Knights in the y and z files; Black has Bishops in the y and z files.

Thus, there are 22 variants in all.

The above example applications, relating to the present invention, should not, of course, be construed as limiting the scope of the invention. Such variations of the invention, now known or later developed, which would fall within the purview of those skilled in the art are to be considered as falling within the scope of the invention as hereinafter claimed. For example, series of boards, pocket boards, magnetic boards and sets, and computer programs and computers for playing Next Chess are all encompassed by the present invention.

All patents and publications mentioned in the specification are indicative of the levels of those skilled in the art to which the invention pertains. All patents and publications are herein incorporated by reference to the same extent as if each individual publication was specifically and individually indicated to be incorporated by reference.

The invention illustratively described herein suitably may be practiced in the absence of any element or elements, limitation or limitations which is not specifically disclosed herein. Thus, for example, in each instance herein any of the terms "comprising", "consisting essentially of", "consisting of" and "containing" may be replaced with either of the other two terms. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

Other embodiments are within the following claims.

What is claimed is:

1. A method of playing a chess game for two players comprising the steps of:

(a) providing a rectangular game board having a grid of squares consisting of eight rows and ten columns;

(b) providing a plurality of chessmen divided into two sets of chessmen, one set for each player, each set consisting of 22 chessmen, each set having a different color or appearance to distinguish each set, each set consisting of ten Pawns, a King, a Queen, two Rooks, four Bishops and four Knights;

(c) setting up the game by placing each set of chessmen on opposite sides of the board, each player placing only 20 of their 22 chessmen on the board by placing all ten Pawn, the King, the Queen, the two Rooks, at least two Bishops and at least two Knights on the board, plus each player in addition deciding either: 1) to place two additional Bishops on the board, or 2) to place two additional Knights on the board, or 3) to place one additional Bishop and one additional Knight on the board, so that each player's set of 20 chessmen set up on the board having either: 1) four Bishops and two Knights on the board, or 2) four Knights and two Bishops on the board, or 3) three Bishops and three Knights on the board, respectively.

* * * * *